US006951577B2

(12) United States Patent
Carter et al.

(10) Patent No.: US 6,951,577 B2
(45) Date of Patent: Oct. 4, 2005

(54) ABRASIVE ARTICLES AND METHOD OF MAKING AND USING THE ARTICLES

(75) Inventors: Christopher J. Carter, Nuneaton (GB); Tracey E. Winspear, Old Glossop (GB)

(73) Assignee: 3M Innovative Properties Company, St. Paul, MN (US)

( * ) Notice: Subject to any disclaimer, the term of this patent is extended or adjusted under 35 U.S.C. 154(b) by 26 days.

(21) Appl. No.: 10/668,757

(22) Filed: Sep. 23, 2003

(65) Prior Publication Data

US 2004/0144037 A1 Jul. 29, 2004

(30) Foreign Application Priority Data

Nov. 7, 2002 (GB) ..... 0225913

(51) Int. Cl.[7] ..... B24D 3/00; B24D 3/34; B24D 11/02

(52) U.S. Cl. ..... 51/298; 51/307; 51/308; 51/309; 51/295; 451/28

(58) Field of Search ..... 51/307, 308, 309, 51/295, 298; 451/28

(56) References Cited

U.S. PATENT DOCUMENTS

| | | | | |
|---|---|---|---|---|
| 4,735,632 A | | 4/1988 | Oxman et al. | |
| 4,773,920 A | | 9/1988 | Chasman et al. | |
| 5,011,513 A | | 4/1991 | Zador et al. | |
| 5,152,917 A | | 10/1992 | Pieper et al. | |
| 5,304,223 A | | 4/1994 | Pieper et al. | |
| 5,368,619 A | | 11/1994 | Culler | |
| 5,391,210 A | | 2/1995 | Bilkadi et al. | |
| 4,773,920 A | | 5/1995 | Chasman et al. | |
| 5,536,760 A | * | 7/1996 | Friedlander et al. | 522/96 |
| 5,549,962 A | | 8/1996 | Holmes et al. | |
| 5,667,541 A | | 9/1997 | Klun et al. | |
| 5,152,917 A | | 1/1998 | Pieper et al. | |
| 6,187,070 B1 | * | 2/2001 | Gaeta et al. | 51/298 |
| 2002/0016379 A1 | | 2/2002 | Gaeta et al. | |

FOREIGN PATENT DOCUMENTS

| | | |
|---|---|---|
| EP | 0 654 323 A1 | 5/1995 |
| GB | 0225913.3 | 11/2002 |
| WO | WO 97/36713 | 10/1997 |
| WO | WO 02/28802 A2 | 4/2002 |

* cited by examiner

*Primary Examiner*—Michael Marcheschi

(57) ABSTRACT

An abrasive article comprising abrasive particles and a UV-cured formulation and a filler, wherein the filler is substantially transparent to UV-radiation and the filler is present in a range from 20 to 80 percent by weight based on the combined weight of the formulation and filler and the filler comprises microspheres of aluminosilicate ceramic having an average particle size in a range of from 1 micrometer to 40 micrometers. A method of making and using the abrasive articles is also provided.

33 Claims, No Drawings

ABRASIVE ARTICLES AND METHOD OF MAKING AND USING THE ARTICLES

RELATED APPLICATION

This application claims priority from British Patent Application No. 0225913.3, filed Nov. 7, 2002.

BACKGROUND OF THE INVENTION

The present invention relates to abrasive articles and to a method of making and using abrasive articles. In particular, the present invention relates to abrasive articles comprising a UV-cured binder and filler.

Abrasive articles typically comprise a plurality of abrasive particles and a binder. There are a number of different types of abrasive articles on the market. These include coated abrasive products, bonded abrasive products and nonwoven abrasive products.

Coated abrasive products generally include a backing, abrasive particles, and at least one binder to hold the abrasive particles in an abrasive layer onto a major surface of the backing. The abrasive layer can be, for example, a single layer (e.g., a slurry layer) or multiple layers (e.g., make and size layers). The slurry layer may be applied as a slurry of abrasive particles in a binder precursor that is subsequently cured to form the binder. Such slurries of abrasive particles in a binder precursor and techniques for applying them are well known in the abrasive art. Make and size layers and methods for applying them are also well known in the abrasive art. In addition to adhering the abrasive particles to the backing, the make coat may also serve to seal the backing. The backing may be any suitable material including, but not limited to, cloth, polymeric film, fibre, woven fabric, nonwoven web, paper, or combinations thereof, or treated versions thereof. The abrasive particles can be present in one or more layers of the coated abrasive product.

Bonded abrasive products typically include a shaped mass of abrasive particles held together by an organic, metallic, or vitrified binder. Such shaped mass can be, for example, in the form of a wheel, such as a grinding wheel or cutoff wheel. The shaped mass can also be in the form, for example, of a honing stone, segment, mounted point, disc (e.g., double disc grinder) or other conventional bonded abrasive shape.

Nonwoven abrasive products typically include an open porous lofty polymer filament structure having abrasive particles distributed throughout the structure and adherently bonded therein by an organic binder. Examples of filaments include, but are not limited to, polyester fibers, polyamide fibers, and polyaramid fibers.

Abrasive articles typically include at least one binder (e.g., in make, size, and/or slurry layers of coated abrasive articles, or coated on a fiber web of nonwoven abrasive articles). Typically, binders are formed by curing (e.g., by thermal means, or by using electromagnetic or particulate radiation) one or more binder precursors. Useful binders and binder precursors may be inorganic or organic. Useful binder precursors include thermally curable resins and radiation curable resins, which may be cured, for example, thermally and/or by exposure to radiation. Exemplary organic binder precursors include glue, phenolic resin, aminoplast resin, urea-formaldehyde resin, melamine-formaldehyde resin, urethane resin, (e.g., an aminoplast resin having pendant $\alpha,\beta$-unsaturated groups, acrylated urethane, acrylated epoxy, acrylated isocyanurate), acrylic resin, epoxy resin (including bis-maleimide and fluorene-modified epoxy resins), isocyanurate resin, as well as mixtures thereof.

Binders used to produce abrasive articles often contain fillers. Fillers are typically organic or inorganic particulates dispersed within the resin and may, for example, modify either the binder precursor or the properties of the cured binder, or both, and/or may simply, for example, be used to reduce cost. In coated abrasives, the fillers may be present, for example, to block pores and passages within the backing to reduce its porosity and provide a surface to which the maker coat will bond effectively. The addition of a filler, at least up to a certain extent, typically increases the hardness and toughness of the cured binder. Inorganic particulate filler commonly has an average particle size ranging from about 1 micrometer to about 100 micrometers, more preferably from about 5 to about 50 micrometers, and sometimes even from about 10 to about 25 micrometers. Depending on the ultimate use of the abrasive article, the filler typically has a specific gravity in the range of 1.5 to 4.5, and an average particle size of the filler will preferably be less than the average particle size of the abrasive particles.

Examples of useful fillers include: metal carbonates such as calcium carbonate (in the form of chalk, calcite, marl, travertine, marble or limestone), calcium magnesium carbonate, sodium carbonate, and magnesium carbonate; silicas such as quartz, glass beads, glass bubbles and glass fibers; silicates such as talc, clays, feldspar, mica, calcium silicate, calcium metasilicate, sodium aluminosilicate, and sodium silicate; metal sulfates such as calcium sulfate, barium sulfate, sodium sulfate, aluminium sodium sulfate, and aluminium sulfate; gypsum; vermiculite; wood flour; alumina trihydrate; carbon black; metal oxides such as calcium oxide (lime), aluminium oxide, titanium dioxide, alumina hydrate, alumina monohydrate; and metal sulfites such as calcium sulfite.

The use of UV-curable coating compositions in the preparation of coated abrasives is known. One of the problems associated with the use of UV-curable coating compositions in coated abrasives is that heavy filler loadings cause a shadowing effect and are inherently difficult to cure because the composition behind particles of filler tend to prevent penetration of UV-radiation throughout the depth of the coating. The problem is exacerbated in make coatings since the presence of the abrasive particles embedded in the partially cured coating also contributes to the shadowing effect.

WO97/36713, published Oct. 9, 1997, reports a coating composition suitable for the production of coated abrasives comprising a UV-polymerizable formulation and an alumina trihydrate filler that is substantially transparent to UV-light, wherein the amount of alumina trihydrate is said to be from 25 to 50% by volume of the coating composition.

SUMMARY OF THE INVENTION

The present invention provides abrasive articles, particularly coated abrasives comprising a UV-cured formulation and filler, and a method of making and using such abrasive articles.

According to the present invention there is provided an abrasive article comprising abrasive particles and a UV-cured formulation and a filler, wherein the filler is substantially transparent to UV-radiation and the filler is present in a range of from 20 to 80% (in some embodiments, 40 to 60%) by weight of the combined weight of the formulation and filler and the filler comprises microspheres of aluminosilicate ceramic having an average particle size in a range of from about 1 micrometer to about 40 micrometers.

In a further aspect, the invention provides a method of making an abrasive article, the method comprising providing abrasive particles and a UV-curable formulation and a filler, wherein the filler is substantially transparent to UV-radiation and the filler is present in a range from about 20 to about 80 percent by weight based on the combined weight of the cured formulation and filler and the filler comprises microspheres of aluminosilicate ceramic having an average particle size in a range of from about 1 micrometer to about 40 micrometers; and curing the UV-curable formulation by exposing it to UV-radiation for a time sufficient to effect cure of the UV-curable formulation In a further aspect, the invention provides a method of abrading the surface of a substrate comprising contacting an abrasive article comprising abrasive particles and a UV-cured formulation and a filler, wherein the filler is substantially transparent to UV-radiation and the filler is present in a range from about 20 to about 80 percent by weight based on the combined weight of the formulation and filler and the filler comprises microspheres of aluminosilicate ceramic having an average particle size in a range of from about 1 micrometer to about 40 micrometers with the substrate surface and moving at least one of the abrasive article or the substrate to abrade the surface.

As used herein, the following terms will be defined as follows:

"UV-cured formulation" is a curable binder formulation which has been cured by exposure to ultraviolet radiation.

"UV-curable formulation" is a binder precursor formulation which will cure to a hardened state upon exposure to ultraviolet radiation.

A filler which is "substantially transparent to UV-radiation" will only block a small percentage of UV-radiation passing therethrough while permitting the passage of most of the UV-radiation.

In one embodiment, according to the present invention, the abrasive article is in the form of a coated abrasive comprising abrasive particles which are supported on and adherently bonded to at least one major surface of a backing sheet by a make coating of a first resinous material and a size coating of a second resinous material, wherein at least some of the first or second resinous materials comprises the UV-cured binder and filler.

It has been found that solid microspheres that are transparent to UV-radiation are particularly suitable for coatable compositions comprising a UV-polymerizable binder system. Typically, the microspheres may be incorporated in the compositions in high levels (e.g., up to 80 weight %) while still providing acceptable viscosities for coating. The compositions may be readily cured by exposure to UV-light, which is able to penetrate deeply into the coated compositions. In most UV-curable binder systems, the flexural modulus increases with higher levels of microspheres. The coatable compositions can be used, for example, for the production of abrasive articles (e.g., coated abrasives). Advantages of curable compositions according to the present invention include lower raw material cost as the microsphere-filled UV-curable formulation is lower in cost compared with an unfilled UV curable system. The use of other conventional fillers, which could prevent the passage of UV radiation through the material, increase the viscosity markedly, and reduce or entirely prevent curing should be avoided. Reduced curing results in a reduction in physical properties such as modulus and toughness, and therefore may render the material unsatisfactory in an abrasive formulation.

The microspheres used in the present invention are transparent to light in the range 200 nanometers to 450 nanometers. In some embodiments, for example, where the coatable composition comprises visible light activated catalysts, the microspheres are transparent to visible light. The microspheres are formed of ceramic and have an average particle size in a range of from about 1 micrometer to about 40 micrometers, preferably in a range from about 1 micrometer to about 20 micrometers. Ceramics comprise engineering materials or products that are chemically inorganic, except metals and alloys and are usually rendered serviceable through high temperature processing (Encyclopedia of Glass, Ceramics, Clay and Cement, Grayson, P232. ISBN 0-471-81931-x.). Suitable microspheres are commercially available, for example, under the trade designation "ZEEOSPHERES" from 3M Company, St. Paul, Minn., USA. In some embodiments, preferred microspheres include those available under the trade designation "W210 ZEEOSPHERES", from 3M Company, which have an average particle size of about 3 micrometers and a particle size distribution in a range from 1 micrometer to 12 micrometers.

A filler is considered for the purposes of this invention to be transparent to this light if, when a composition containing the UV-curable formulation and 25% by weight of the uniformly distributed filler, is exposed to UV radiation and the depth of cure obtained is at least 50% of the depth of cure attained when the formulation without the filler receives the same amount of UV radiation.

The depth of cure is measured by coating a composition on a surface and exposing it to a UV radiation source for a predetermined time. The result is the formation of a thin crust on the surface of the coating. The thickness of this crust is a measure of the relative depth of penetration of the UV radiation.

Typically, for curable compositions according to the present invention used to make coated abrasive articles, the microspheres are present in an amount from about 20 to 80% by weight of the composition, in some embodiments from about 40 to 60% by weight of the composition.

Compositions according to the present invention may further comprise other fillers in addition to the microspheres. However, since most fillers are not transparent to UV-radiation and the presence of significant amounts of such fillers may deleteriously affect the curing properties of the composition. Surprisingly, it has been found that mica may be advantageously used as a filler in combination with the UV transparent microspheres. While not wanting to be bound by theory, it is believed that although mica is opaque to UV-radiation, it is transparent to visible light and the presence of a visible light activated catalyst in the compositions ensures full cure of the binder system. In some embodiments, the compositions comprise up to about 22% by weight mica. Further, in some embodiments, the weight of microspheres in the coatable composition is greater than the weight of mica.

The UV-curable component of the compositions of the present invention may comprise such materials known in the art suitable for the production of abrasive articles, wherein the UV-curable component is curable on exposure to UV light in the wavelength range 200 nm to 400 nm, and/or in the presence of a visible light activated catalyst that cures on exposure to visible light in the wavelength range 400 nm to 700 nm.

Suitable UV-curable resins typically are resins that polymerize via a free-radical mechanism. They include epoxy-acrylates, aminoplast derivatives having pendant α,β-unsaturated carbonyl groups, ethylenically unsaturated compounds, isocyanurate derivatives having at least one pendant acrylate group, isocyanates having at least one pendant acrylate group, urethane-acrylates, epoxy-novolacs and mixtures thereof.

Examples of acrylated urethanes include diacrylate esters of hydroxy-terminated isocyanate extended polyesters or polyethers. Acrylated epoxies include, for example, the diacrylate esters of bisphenol derivatives such as bisphenol A epoxy resins. Typical aminoplast derivatives have at least 1.1 pendant α,β-unsaturated carbonyl groups. Suitable ethylenically unsaturated compounds include monomeric or polymeric compounds that contain atoms of carbon, hydrogen and oxygen, and optionally nitrogen and the halogens. Oxygen and nitrogen atoms are generally present in ether, ester, urethane, amide or urea groups. Typically isocyanate derivatives have at least one pendant acrylate group, conventionally made, for example, by the reaction of an acrylate monomer or oligomer, including di- and tri-acrylates, with a novolac, epoxy or urethane polymer or oligomer.

Most binder systems curable by UV-radiation require the presence of a photoinitiator to initiate free-radical polymerization. Examples of suitable photoinitiators include, benzophenones, phosphine oxides, nitroso compounds, acryl halides, hydrazones, mercapto compounds, pyrillium compounds, triacrylimidazoles, benzimidazoles, chloroalkyl triazines, benzoin ethers, benzil ketals, thioxanthones, camphorquinone, and acetophenone derivatives. Cationic photoinitiators may also be used and examples of such photoinitiators include aryl diazonium, arylsulfonium, aryliodonium and ferrocenium salts. Examples of UV-curable binder systems are reported in U.S. Pat. No. 4,735,632 (Oxman et al.), U.S. Pat. No. 4,773,920 (Chasman et al.), U.S. Pat. No. 5,152,917 (Pieper et al.), U.S. Pat. No. 5,304,223 (Pieper et al.), U.S. Pat. No. 5,391,210 (Bilkadi et al.), and U.S. Pat. No. 5,667,541 (Klun et al.).

Coatable compositions according to the present invention may further comprise up to about 2% by weight of a coupling agent based on the total weight of filler. Coupling agents may function to form a stronger bond between the binder and the inorganic particles of filler and abrasive, or the backing. In some embodiments, coupling agents include organo-functional silanes, for example, vinyl functional and methacrylic functional silanes. Although not wanting to be bound by theory, it is believed the presence of the coupling agent increases the toughness of the binder system.

Optionally, coatable compositions according to the present invention may further comprise surfactant and/or other coating aids. The presence of surfactant facilitates good filler dispersion and reduces viscosity. Although not wanting to be bound by theory, it is believed that, in some cases, the presence of surfactant may also increase the flexural modulus of the binder system. Typically, the amount of surfactant is up to 2% by weight of the formulation and filler, generally from 0.3 to 1.2% by weight of formulation and filler, although amounts above 2% by weight may also be useful. Any of a wide range of surfactants may be used including those having the trade designations "LICA 09", "KRTTS", "LICA 385", "LICA N709", "K755", "K70PPR" (available from Kenrich Petrochemicals, Inc., Bayonne, N.J., USA), "SILANE GF80" (available from Wacker-Chemie GmbH, Munich, Germany), "BYK 980", "BYK 9010" and "BYK 985" (Byk-Chemie, Wesel, Germany).

The backing can be any of a number of various materials conventionally used as backings in the manufacture of coated abrasives, such as paper, cloth, film, vulcanized fibre, woven and nonwoven materials, and the like, or a combination of two or more of these materials or treated versions thereof. The choice of backing material may depend, for example, on the intended application of the abrasive article. Typically, the strength of the backing should be sufficient to resist tearing or other damage in use, and the thickness and smoothness of the backing should allow achievement of the product thickness and smoothness desired for the intended application. Further, the adhesion of the inventive coatable composition or other binder to the backing typically should also be sufficient to prevent significant shelling of individual abrasive particles or the abrasive coating during normal use. In some applications, it is desirable that the backing be waterproof. The thickness of the backing should be sufficient to provide the strength desired for the intended application; nevertheless, it should not be so thick as to adversely affect the desired flexibility in the coated abrasive product. For lapping coated abrasives, one exemplary backing is polymeric film, such as polyester film. The film may be primed with a material, such as ethylene acrylic acid copolymer, to promote adhesion of the inventive slurry or dispersion and resulting abrasive composite to the film. In some embodiments of the coated abrasive article it may be desirable to utilize a backing transparent to UV/visible radiation.

Embodiments of coatable composition according to the present invention are useful, for example, for the preparation of coated abrasives. For example, the compositions may be used as the make and/or size coat of the coated abrasive article. In some embodiments, the size coat of the coated abrasive article is made using the composition of the present invention.

In the case of a woven backing, it is sometimes desirable, for example, to fill the interstices of the backing with at least one coating before the application of a coatable composition according to the present invention. Coatings used for this purpose are called saturant, back or presize coatings, as previously described, depending on how and to what surface of the backing the coating is applied.

In some embodiments, the backing may comprise a laminate of backings made by laminating two or more plies of either similar or dissimilar backing materials. For example, the backing can be laminated to a stiffer, more rigid substrate, such as a metal plate, to produce a coated abrasive article having an abrasive coating supported on a rigid substrate.

The major surface of the backing opposite the abrasive coating may, in some embodiments, include a pressure-sensitive adhesive or one member of a hook and loop type attachment system so that the abrasive article can be secured to a back-up pad. Examples of pressure-sensitive adhesives suitable for this purpose include rubber-based adhesives, acrylate-based adhesives, and silicone-based adhesives.

Suitable abrasive particles may be selected from those commonly used in the abrasive art, however, the abrasive particles (size and composition) will be chosen, for example, with the application of the abrasive article in mind. In choosing an appropriate abrasive particle, characteristics such as light absorption, hardness, compatibility with the intended workpiece, particle size, reactivity with the workpiece, as well as heat conductivity may also be considered.

The composition of abrasive particles useful in the present invention can be divided into two classes: natural abrasives and manufactured abrasives. Examples of useful natural abrasives include: diamond, corundum, emery, garnet (offred color), buhrstone, chert, quartz, sandstone, chalcedony, flint, quartzite, silica, feldspar, pumice and talc. Examples of manufactured abrasives include: boron carbide, cubic boron nitride, fused alumina, ceramic aluminium oxide, heat treated aluminium oxide (both brown and dark grey), alumina zirconia, glass, silicon carbide (preferably green, although small amounts of black may be tolerated), iron oxides, tantalum carbide, cerium oxide, tin oxide, titanium carbide, synthetic diamond, manganese dioxide, zirconium oxide, ceramics, including those made by a sol gel process and silicon nitride.

In some embodiments abrasive particles useful in the present invention typically have a particle size ranging from about 0.1 micrometer to about 1500 micrometers, more typically ranging from about 0.1 micrometer to about 1300 micrometers. Typically, the abrasive particles used in the present invention have a Moh's hardness of at least 8, more typically above 9; however, abrasive particles having a Moh's hardness of less than 8 may be used.

The term "abrasive particle" includes agglomerates of individual abrasive particles. An abrasive agglomerate is formed when a plurality of abrasive particles are bonded together with a binder to form a larger abrasive particle which may have a specific particulate structure. The plurality of particles that form the abrasive agglomerate may comprise more than one type of abrasive particle, and the binder used may be the same as or different from the binders used to bind the agglomerate to a backing.

Precisely shaped abrasive particles may also be employed. These precisely shaped abrasive particles may be produced essentially by coating a structured tool with a slurry of abrasive particles and binder precursor, curing the binder precursor, and detaching the resulting composites from the tool by exposing the tool to an ultrasonic horn, as reported in U.S. Pat. No. 5,152,917 (Pieper et al.) and U.S. Pat. No. 5,549,962 (Holmes et al.).

EXAMPLES

Advantages and embodiments of this invention are further illustrated by the following Examples, but the particular materials and amounts thereof recited in these examples, as well as other conditions and details, should not be construed to unduly limit this invention. All parts and percentages are by weight unless otherwise indicated. In the Tables the amounts of the components of the formulations are in parts by weight unless otherwise indicated.

In the Examples the following materials were used:

"P.80" refers to blue aluminium oxide mineral, obtained under the trade designation "BFRPL" from Treibacher Schleifmittel UK Ltd, The Old Barn, Dunsborough Park, Ripley, Woking, Surrey, GU236AL, UK.

Trimethylol propane triacrylate obtained under the trade designation "TMPTA" from UCB Radcure Specialties, Smyrna, Ga., USA.

Vinylester resin obtained under the trade designation "GENOMER 2258" from Rahn AG, Dorflistrasse 120, CH-8050, Zurich, Switzerland.

Hexanediol diacrylate obtained under the trade designation "GENOMER 1223" from Rahn AG, Zurich, Switzerland.

Ethoxylated trimethylolpropane triacrylate obtained under the trade designation "GENOMER 1343" from Rahn AG, Zurich, Switzerland.

The diacrylate ester of bisphenol A epoxy resin obtained under the trade designation "GENOMER 2263" from Rahn AG, Zurich, Switzerland.

Wetting agent obtained under the trade designation "GENORAD 10" from Rahn AG.

Cycloaliphatic epoxy resin obtained under the trade designation "UVACURE 1500" from UCB Radcure Specialities.

Cycloaliphatic epoxy resin obtained under the trade designation "ERL 4221" from Dow Chemical Co., Midland, Mich., USA.

Free radical catalyst obtained under the trade designation "DAROCURE 1173" from Ciba Speciality Chemicals, Basel, Switzerland.

Cationic catalyst obtained under the trade designation "CPI6976" from Aceto Corp., Lake Success, N.Y., USA.

Cationic catalyst obtained under the trade designation "UVI 6974" from Dow Chemical Co.

Alkali aluminosilicate ceramic microspheres obtained under the trade designation "ZEEOSPHERES W 210", "ZEEOSPHERES W 410", "ZEEOSPHERES W 610" from the 3M Company, St. Paul, Minn., USA.

Silica-alumina ceramic microspheres, obtained under the trade designation "ZEEOSPHERES G200", from the 3M Company.

A mica obtained under the trade designation "SX400" from Microfine Minerals Ltd., Derby, U.K.

A feldspar obtained under the trade designation "MINEX" from North Cape Minerals AS, Rud, Norway.

Wetting agent obtained under the trade designation "BYK W-985" from BYK-Chemie GmbH, Abelstraβe 45, P.O. Box 100245, D-46462 Wesel, Germany.

A methacrylate polymer obtained under the trade designation "PARALOID 2655" from Rohm and Haas (UK) Ltd., Lennig House, 2 Mason's Avenue, Croydon, Surrey CR9 3NB, UK.

A free-radical catalyst obtained under the trade designation "GENOCURE MBF" from Rahn AG.

A free-radical catalyst obtained under the trade designation "IRGACURE 819" from Ciba Speciality Chemicals, Charter Way, Macclesfield, Chesire SK10 2 NX, UK.

Photoinitiators obtained under the trade designations "SPEEDCURE BEM", "SPEEDCURE DMB", "SPEEDCURE EDB", "SPEEDCURE PBZ" and "SPEEDCURE TPO" from Lambson Group Ltd, 103–105, Station Parade, Harrogate, N. Yorkshire, HG1 1HB, UK.

Surfactants, obtained under the trade designations "LICA 09", "KRTTS", "38J", "KZ55", "KZOPPR", "NZ09" and "NZ38" from Kenrich Petrochemicals Inc., Bayonne, N.J., USA.

Example 1

The following components and amounts (see Table 1, below) were used to make Example 1 samples.

TABLE 1

| Component | Example 1.1 | Example 1.2 | Example 1.3 | Example 1.4 |
|---|---|---|---|---|
| "GENOMER 2258" | 3.55 | 3.55 | 3.55 | 3.55 |
| "GENOMER 1343" | 33.39 | 33.39 | 33.39 | 33.39 |
| "TMPTA" | 18.08 | 18.08 | 18.08 | 18.08 |
| "GENOCURE MBF" | 2 | 2 | 2 | 2 |

TABLE 1-continued

| Component | Example 1.1 | Example 1.2 | Example 1.3 | Example 1.4 |
|---|---|---|---|---|
| "SPEEDCURE PBZ" | 1.6 | 1.6 | 1.6 | 1.6 |
| "IRGACURE 819" | 0.4 | 0.4 | 0.4 | 0.4 |
| "SPEEDCURE EDB" | 1.2 | 1.2 | 1.2 | 1.2 |
| "BYK W-985" | 0 | 0.09 | 0.23 | 0.51 |
| "W210-ZEEOSPHERES" | 0 | 14.49 | 37.85 | 85.28 |
| "GENORAD 10" | 1.15 | 1.15 | 1.15 | 1.15 |
| WEIGHT % "ZEEOSPHERES" | 0 | 19 | 38 | 58 |

The compositions were prepared by first adding the resins (GENOMER 2258 vinyl ester resin, GENOMER 1343 ethoxylated trimethylol propane, TMPTA), warming to 60° C., then adding the BYK W-985 wetting agent, then adding the filler (W-210 ZEEOSPHERES microspheres), mixing ultrasonically until smooth using a BRANSONIC 2210 ultrasonic bath supplied by Worldwide Headquarters, Branson Ultrasonics Corp., 41 Eagle Rd., Danbury, Conn. 06813, USA, then adding the catalysts (GENOCURE MBF catalyst, SPEEDCURE PBZ photo initiator, IRGACURE 819 catalyst, SPEEDCURE EDB photoinitiator), then adding the GENORAD 10 wetting agent and stirring until smooth and de-gassed for 10 minutes at 60° C. and 5 minutes at 60° C., respectively. Four slabs of each mix were made by UV-curing in molds of dimensions 9 mm wide×75 mm long×1 mm thick. A single lamp "D-bulb" UV curing unit obtained under the trade designation "MINICURE" from Primark UV Technology of Primark Limited, A Nordson Company, 816 Leigh Road, Slough, Berkshire, SL1 4BD, U.K. was used, with a belt speed of 10 cm/second, and a power setting of the "D-bulb" of 65%, that gave a UV dose of 480 milliJoules/cm$^2$ and a temperature of 53° C., as measured by a "POWER PUCK" UV dose meter obtained from DDU ENTERPRISES, 2909 Oregon Court, Suite A-2, Torrance, Calif. 90503, USA. The slabs were then annealed, with a thermal cure of 24 minutes at 110° C.

Example 1.1 had a low viscosity and seemed more brittle than the other formulations. Example 1.2 was less brittle and shrank less. Example 1.3 produced strips that were not noticeably less brittle than Example 1.2 but showed less shrinkage. Example 1.4 showed less shrinkage than the other formulations.

The slabs were sanded against "P1000 WETOrDRY" sandpaper obtained under the trade designation "3M 312" from the 3M Company followed by 15 micrometers then 7 micrometers sandpaper micro-finishing film obtained under the trade designation 3M 268L from 3M Company, by hand sanding parallel to the edges until smooth (about 10 passes on each edge on each grade of sandpaper). This sanding process removed flaws along the edges that would reduce the physical properties. The resulting slabs were tested in three point bend mode on a flexural modulus testing apparatus, obtained from Instron Corp., Canton, Mass., USA, under the trade designation "INSTRON 4301". The results are provided in Table 2, below.

TABLE 2

| % "ZEEOSPHERES" | Flexural Modulus, MPa |
|---|---|
| 0 | 785.4 |
| 19 | 702.4 |
| 38 | 1025.6 |
| 58 | 1935.4 |

Example 2

The following components and amounts (see Table 3, below) were used to make Example 2 samples. The procedures for making and testing the Example 2 samples was as described in Example 1.

TABLE 3

| Component | Example 2.1 | Example 2.2 | Example 2.3 | Example 2.4 |
|---|---|---|---|---|
| "GENOMER 2263" | 19.87 | 19.87 | 19.87 | 19.87 |
| "TMPTA" | 27.76 | 27.76 | 27.76 | 27.76 |
| "GENOMER 1223" | 4.30 | 4.30 | 4.30 | 4.30 |
| "GENOCURE MBF" | 0.69 | 0.69 | 0.69 | 0.69 |
| "IRGACURE 819" | 0.24 | 0.24 | 0.24 | 0.24 |
| "BYK W-985" | 0.32 | 0.32 | 0.32 | 0.32 |
| "SX400" | 11.70 | 11.70 | 11.70 | 11.70 |
| "W-210 ZEOSPHERES" | 31.94 | — | — | — |
| "W-410 ZEOSPHERES" | — | 31.94 | — | — |
| "W-610 ZEOSPHERES" | — | — | 31.94 | — |
| "G-200 ZEOSPHERES" | — | — | — | 31.94 |
| "GF56" | 0.60 | 0.60 | 0.60 | 0.60 |
| "PARALOID 2655" | 2.58 | 2.58 | 2.58 | 2.58 |

The compositions were prepared by first adding the resins (GENOMER 2263 diacrylate ester of bisphenol A epoxy resin, GENOMER hexandiol diacrylate 1223, TMPTA), warming to 60° C., then adding the BYK W-985 wetting agent, then adding the fillers (ZEEOSPHERES ceramic microspheres, SX400 mica) and PARALOID 2655 methacrylate polymer, mixing ultrasonically until smooth using a BRANSONIC 2210 ultrasonic bath supplied by Worldwide Headquarters, Branson Ultrasonics Corp., 41 Eagle Rd., Danbury, Conn. 06813,USA, then adding GF56 silane with stirring and heating to 75° C. for 45 minutes, then adding the catalysts (GENOCURE MBF, IRGACURE 819), then adding the GENORAD 10 wetting agent and stirring until smooth.

The viscosity of the uncured liquid was measured at 23 degrees C. using a "HAAKE RHEOSTRESS RS75" rheometer Thermo Haake, Thermo Haake HQ, Dieselstrasse 4, Karlsruhe, BW, 76227, Germany with a 3.5 cm cone and plate. In addition to the modulus of Example 2 samples, toughness value was also calculated for each sample by taking the area under the Stress/Strain curve (which equates to the energy required to break the sample=Force×Distance) and dividing by the sample volume between the sample supports (Gauge length×Thickness×Width). Further, it was observed that Example 2.4 did not cure on the side opposite the UV source.

The results are reported in Table 4, below.

TABLE 4

| | Example 2.1 | Example 2.2 | Example 2.3 | Example 2.4 |
|---|---|---|---|---|
| Viscosity, mPas | 383 | 1083 | 945 | — |
| Modulus, MPa | 7335 | 6375 | 6480 | — |
| Toughness, kgs$^{-2}$m$^{-1}$ | 0.070 | 0.064 | 0.076 | — |

"ZEEOSPHERES G-200" silica-alumina ceramic microspheres did not transmit UV radiation.

"ZEEOSPHERES W-210, W-410, W-610", alkali aluminosilicate ceramic microspheres, all produced a suitable cure. Although not wanting to be bound by theory, it is believed that the uncured liquid varies in viscosity due to the different microsphere diameter. Further, it is believed that, as shown in Table 5, below, the larger the microsphere diameter, the higher the viscosity. This finding could be useful in tailoring to achieve desired viscosity to meet, for example, particular coating equipment requirements.

TABLE 5

| "ZEEOSPHERES" Microspheres | | Particle Size, micrometers, by volume Distribution | | | |
|---|---|---|---|---|---|
| Grade | Composition | 10th % | 50th % | 90th % | Effective top size |
| G-200 | Silica-alumina ceramic | 1 | 4 | 10 | 12 |
| W-210 | Alkali alumino-silicate ceramic | 1 | 3 | 11 | 12 |
| W-410 | Alkali alumino-silicate ceramic | 1 | 4 | 15 | 24 |
| W-610 | Alkali alumino-silicate ceramic | 1 | 10 | 28 | 40 |

Example 3

The following compositions were prepared and tested according to the procedures of Example 1 and 2.

TABLE 6

| Component | Example 3.1 | Example 3.2 |
|---|---|---|
| "GENOMER 2258" | 7.71 | 7.71 |
| "GENOMER 2263" | 18.00 | 18.00 |
| "TMPTA" | 25.71 | 25.71 |
| "GENOCURE MBF" | 0.65 | 0.65 |
| "IRGACURE 819" | 0.26 | 0.26 |
| "BYK W-985" | 0.43 | 0.43 |
| "W210 ZEEOSPHERES" | 47.08 | 47.08 |
| "GF56" | 0.00 | 0.59 |
| "PARALOID 2655" | 2.78 | 2.78 |

TABLE 7

| | Example 3.1 | Example 3.2 |
|---|---|---|
| Viscosity, mPas | 652 | 623 |
| Modulus, MPa | 6099 | 5678 |
| Toughness, $kgs^{-2}m^{-1}$ | 0.095 | 0.16 |

TABLE 8

| Component | Example 3.3 | Example 3.4 |
|---|---|---|
| "GENOMER 2258" | 3.48 | 3.45 |
| "GENOMER 1343" | 30.80 | 30.53 |
| "TMPTA" | 21.40 | 21.31 |
| "GENOCURE MBF" | 0.69 | 0.68 |
| "SPEEDCURE BEM" | 0.00 | 0.00 |
| "IRGACURE 819" | 0.28 | 0.28 |
| "BYK W-985" | 0.35 | 0.35 |
| "W210 ZEEOSPHERES" | 21.50 | 21.31 |
| "GF56" | 0.00 | 0.78 |
| "SX400" | 21.50 | 21.31 |

TABLE 9

| | Example 3.3 | Example 3.4 |
|---|---|---|
| Viscosity, mPas @ 60 C | 358 | 262 |
| Modulus, MPa | 6423 | 7270 |
| Toughness, $kgs^{-2}m^{-1}$ | 0.046 | 0.052 |

TABLE 10

| Component | Example 3.5 | Example 3.6 | Example 3.7 | Example 3.8 |
|---|---|---|---|---|
| "SPEEDCURE 2263" | 25.71 | 25.71 | 25.71 | 25.71 |
| "TMPTA" | 10.71 | 10.71 | 10.71 | 10.71 |
| "SPEEDCURE 1223" | 15.00 | 15.00 | 15.00 | 15.00 |
| "BYK W-985" | 0.43 | 0.43 | 0.43 | 0.43 |
| "PARALOID 2655" | 2.78 | 2.78 | 2.78 | 2.78 |
| "W210 ZEEOSPHERES" | 47.08 | 47.08 | 47.08 | 47.08 |
| "GF31" | 0.9 | 1.2 | 1.5 | 1.8 |
| "GENOCURE MBF" | 0.65 | 0.65 | 0.65 | 0.65 |
| "IRGACURE 819" | 0.26 | 0.26 | 0.26 | 0.26 |

TABLE 11

| Component | Example 3.9 | Example 3.10 | Example 3.11 | Example 3.12 |
|---|---|---|---|---|
| "SPEEDCURE 2263" | 25.71 | 25.71 | 25.71 | 25.71 |
| "TMPTA" | 10.71 | 10.71 | 10.71 | 10.71 |
| "SPEEDCURE 1223" | 15.00 | 15.00 | 15.00 | 15.00 |
| "BYK W-985" | 0.43 | 0.43 | 0.43 | 0.43 |
| "PARALOID 2655" | 2.78 | 2.78 | 2.78 | 2.78 |
| "W210 ZEEOSPHERES" | 47.08 | 47.08 | 47.08 | 47.08 |
| "GF56" | 0.69 | 0.92 | 1.15 | 1.38 |
| "GENOCURE MBF" | 0.65 | 0.65 | 0.65 | 0.65 |
| IRGACURE 819 | 0.26 | 0.26 | 0.26 | 0.26 |

TABLE 12

| "GF31" Methacryl functional silane | | | | |
|---|---|---|---|---|
| Example | % of silane to filler | Viscosity mPas | Mean Modulus MPa | Mean Toughness $kgs^{-2}m^{-1}$ |
| 3.5 | 1.9 | 240 | 5879 | 0.139 |
| 3.6 | 2.5 | 241 | 5598 | 0.115 |
| 3.7 | 3.2 | 227 | 5421 | 0.173 |
| 3.8 | 3.8 | 248 | 5600 | 0.153 |

TABLE 13

| "GF56" Vinyl functional silane | | | | |
|---|---|---|---|---|
| Example | % of silane to filler | Viscosity mPas | Mean Modulus MPa | Mean Toughness $kgs^{-2}m^{-1}$ |
| 3.9 | 1.5 | 250 | 5472 | 0.132 |
| 3.10 | 2.0 | 220 | 5331 | 0.129 |
| 3.11 | 2.4 | 216 | 5380 | 0.106 |
| 3.12 | 2.9 | 166 | 4831 | 0.172 |

Examples 4

Example 4.1

TABLE 14

| Component | |
|---|---|
| "TMPTA" | 19.4 |
| "ERL-4221" | 45.3 |
| "DAROCURE 1173" | 0.6 |
| "UVI-6974" | 1.9 |
| "BYK W-985" | 0.4 |
| "SX400" | 32.3 |

This example was prepared and poured into a mold as in Example 1. The example was cured by passing through the "MINICURE" UV curing unit twice. The front side was cured but the back was still liquid.

Example 4.2

TABLE 15

| Component | |
|---|---|
| "TMPTA" | 19.8 |
| "ERL-4221" | 46.3 |
| "DAROCURE 1173" | 0.6 |
| "IRGACURE 819" | 0.1 |
| "UVI-6974" | 2.0 |
| "BYK W-985" | 0.3 |
| "SX400" | 30.9 |

This example was prepared and poured into a mold as in Example 1. The example was cured by passing through the "MINICURE" UV curing unit twice. The front and back sides were both cured demonstrating the advantage of the visible light curing action of IRGACURE 819 catalyst with SX400 mica filled examples.

In a further experiment, SPEEDCURE TPO was found to be another suitable visible light catalyst.

TABLE 16

| Component | Example 4.3 | Example 4.4 |
|---|---|---|
| "GENOMER 2263" | 19.50 | 19.50 |
| "TMPTA" | 27.24 | 27.24 |
| "BYK W-985" | 4.22 | 4.22 |
| "GENOCURE MBF" | 0.31 | 0.31 |
| "IRGACURE 819" | 0.24 | — |
| "SPEEDCURE TPO" | — | 0.24 |
| "SPEEDCURE PBZ" | 0.52 | 0.52 |
| "SPEEDCURE DMB" | 0.59 | 0.59 |
| "ZEEOSPHERES W-210" | 31.34 | 31.34 |
| "SX-400" | 11.48 | 11.48 |
| GF56 | 0.59 | 0.59 |
| "PARALOID 2655" | 2.53 | 2.53 |
| "GENORAD 10" | 1.08 | 1.08 |

TABLE 17

| | Example 4.3 | Example 4.4 |
|---|---|---|
| Modulus, MPa | 6572 | 6599 |
| Toughness, $kgs^{-2}m^{-1}$ | 0.07 | 0.07 |

Example 5

TABLE 18

| Component | Example 5.1 | Example 5.2 | Example 5.3 |
|---|---|---|---|
| GENOMER 2263 | 20.0 | 20.0 | 20.0 |
| "TMPTA" | 19.1 | 19.1 | 19.4 |
| "HDDA" | 12.0 | 12.0 | 12.0 |
| "GENOCURE MBF" | 0.8 | 0.8 | 0.8 |
| "IRGACURE 819" | 0.3 | 0.3 | 0.3 |
| "BYK W-985" | 0.2 | 0.2 | 0.2 |
| "W210 ZEEOSPHERES" | 44.3 | 34.2 | 26.8 |
| "SX-400" | 0.0 | 10.14 | 17.54 |
| "GF56" | 0.56 | 0.61 | 0.64 |
| "PARALOID 2655" | 3.29 | 3.29 | 3.29 |
| Modulus, MPa | 5724 | 6765 | 7527 |
| Toughness, $kgs^{-2}m^{-1}$ | 0.13 | 0.09 | 0.06 |

Increased levels of mica increase flexural modulus and decrease toughness.

Example 6

The following coating composition was prepared and tested as in Example 1 and 2:

Example 6.1

TABLE 19

| | |
|---|---|
| "TMPTA" | 25.78 |
| "GENOMER 2263" | 25.78 |
| "GENOCURE MBF" | 0.66 |
| "IRGACURE 819" | 0.27 |
| "BYK W-985" | 0.44 |
| "W-210 ZEEOSPHERES" | 47.08 |

The cured composition had a flexural modulus of 10340 MPa and toughness 0.039 $kgs^{-2}m^{-1}$.

An abrasive material was prepared comprising a 3M manufactured 2.97 thousands of an inch thick (75.4 micrometers) polyester backing, 20 $g/m^2$ UV cured hot-melt polyester make adhesive, 180 $g/m^2$ abrasive grains comprising 30% of a sol-gel 80 grit alumina abrasive grain product, marketed by the 3M Company under the trade designation "CUBITRON 222" and 70% "P.80" blue aluminium oxide (Treibacher BFRPL), Example 7.1 as the size at 140 $g/m^2$, and a conventional calcium stearate/styrene acrylate binder supersize at a 11 $g/m^2$.dry coating weight. The make and supersize formulations were identical to those used on the coated abrasive product commercially available under the trade designation "3M 255P STIKIT" from 3M Company.

The abrasive material was converted into self-adhesive discs and tested on a random orbital sander sanding body-filler, using "Test Method for Cut" described below, and its performance compared with a coated abrasive product marketed by 3M Company under the trade designation "255P STIKIT." A 10% improvement in cut over the commercial product was observed.

Test Method for Cut a) Filler Panel Preparation

The polyester body filler used was that commercially available under the trade designations "STANDOX POLYESTER", "EXPRESS PLASTIC", "EXPRESS BODY FILLER" and "STANDOX HARDENER PASTE" from Standox UK, Du Pont Performance Coatings (UK) Ltd., Freshwater Road, Dagenham, Essex, RM8 1RU, UK. The filler was stored at 20° C. for 24 hours before testing. The ratio used was 800 parts by weight of filler to 24 parts by weight of hardener. The total amount of filler needed for all the test program was blended using a pneumatic stirrer to mix the filler until it was of a consistent viscosity with all lumps removed.

b) Mixing

According to the polyester filler mixing instructions, the requisite ratio of polyester filler and hardener paste was poured into a beaker. This was mixed well ensuring an even distribution of the hardener, and poured directly into a clean mold, spreading it evenly in the mold in order to produce a slab of uniform thickness. The mold was vibrated by tapping it on the work surface, to bring any air bubbles to the surface. The time of mixing was written on the side of the aluminium plate. At approximately 40 minutes the mold was removed after cutting through the double sided tape on the inside of the mold.

c) Testing 1 hour after mixing the filler panels were ready for testing. It had a test life of 30 minutes, so the panels needed to be mixed to produce a new one every 30 minutes.

d) Sander

A 10 mm Desoutter random orbital pneumatic sander, model number 567. available from Desoutter Sales Ltd, Eaton Road, Hemel Hempstead, Hertfordshire HP2 7DR was set up with a hard foam backup pad. Several discs were used for each test lot. Each panel was weighed before and after sanding for 75 and 135 seconds. The weight loss of a panel was the measure of "cut".

Example 7

Formulations listed in Table 20 and 22 were compared with the size used in a standard conventional abrasive, a coated abrasive product marketed by the 3M Company under the trade designation "3M 255P STIKIT," a typical urea formaldehyde size construction.

The following coating compositions were prepared and tested as in Example 1 and 2:

TABLE 20

| Component | Example 7.1 | Example 7.2 | Example 7.3 | Example 7.4 | Example 7.5 | Example 7.6 |
|---|---|---|---|---|---|---|
| "GENOMER 2263" | 22.83 | 22.41 | 8.24 | 2.21 | 5.37 | 16.15 |
| "TMPTA" | 19.86 | 11.99 | 25.15 | 28.33 | 13.38 | 11.83 |
| "GENOMER 1223" | 21.39 | 25.61 | 20.46 | 20.02 | 25.26 | 22.33 |
| "GENOCURE MBF" | 0.81 | 0.76 | 0.68 | 0.64 | 0.56 | 0.64 |
| "IRGACURE 819" | 0.33 | 0.30 | 0.27 | 0.26 | 0.22 | 0.26 |
| "BYK W-985" | 0.21 | 0.24 | 0.27 | 0.33 | 0.35 | 0.31 |
| "W-210 ZEEOSPHERES" | 26.86 | 27.82 | 37.33 | 29.30 | 40.09 | 35.44 |
| "SX400" | 4.70 | 7.78 | 4.47 | 15.68 | 11.29 | 9.98 |
| "GF56" | 0.42 | 0.48 | 0.54 | 0.63 | 0.70 | 0.61 |
| "PARALOID 2655" | 2.59 | 2.59 | 2.59 | 2.59 | 2.78 | 2.45 |

TABLE 21

| | Example 7.1 | Example 7.2 | Example 7.3 | Example 7.4 | Example 7.5 | Example 7.6 |
|---|---|---|---|---|---|---|
| Modulus, MPa | 4377 | 5000 | 6000 | 8005 | 7942 | 5771 |
| Toughness, $kgs^{-2}m^{-1}$ | 0.13 | 0.15 | 0.12 | 0.06 | 0.03 | 0.17 |

TABLE 22

| C mp nent | Example 7.7 | Example 7.8 | Example 7.9 | Example 7.10 | Example 7.11 | Example 7.12 |
|---|---|---|---|---|---|---|
| "GENOMER 2263" | 14.77 | 25.07 | 27.35 | 19.87 | 25.24 | 21.83 |
| "TMPTA" | 17.03 | 23.31 | 21.00 | 27.76 | 25.14 | 22.64 |
| "GENOMER 1223" | 22.59 | 8.92 | 6.19 | 4.30 | 0 | 3.95 |
| "GENOCURE MBF" | 0.69 | 0.73 | 0.69 | 0.69 | 0.64 | 0.61 |
| "IRGACURE 819" | 0.28 | 0.29 | 0.28 | 0.24 | 0.26 | 0.25 |
| "BYK W-985" | 0.29 | 0.25 | 0.28 | 0.32 | 0.31 | 0.32 |
| "W-210 ZEEOSPHERES" | 32.41 | 32.19 | 31.80 | 31.94 | 35.38 | 36.84 |
| "SX400" | 9.12 | 5.63 | 8.90 | 11.70 | 9.96 | 10.37 |
| "GF56" | 0.56 | 0.50 | 0.55 | 0.60 | 0.61 | 0.64 |
| "PARALOID 2655" | 2.25 | 3.10 | 2.96 | 2.58 | 2.45 | 2.55 |
| Total | 100 | 100 | 100 | 100 | 100 | 100 |

TABLE 23

| | Example 7.7 | Example 7.8 | Example 7.9 | Example 7.10 | Example 7.11 | Example 7.12 |
|---|---|---|---|---|---|---|
| Modulus, MPa | 4217 | 1581 | 2661 | 7335 | 3704 | 2870 |
| Toughness, $kgs^{-2}m^{-1}$ | 0.33 | 0.78 | 0.83 | 0.07 | 0.09 | 0.07 |

The comparable Modulus and Toughness properties for the standard product, a coated abrasive product marketed by the 3M Company under the trade designation "3M 255P STIKIT" were 6536 MPa and 0.05 $kgs^{-2}m^{-1}$ respectively Various modifications and alterations of this invention will become apparent to those skilled in the art without departing from the scope and spirit of this invention, and it should be understood that this invention is not to be unduly limited to the illustrative embodiments set herein.

What is claimed is:

1. An abrasive article comprising abrasive particles and a UV-cured formulation and a filler, wherein the filler is substantially transparent to UV-radiation and the filler is present in a range from 20 to 80 percent by weight based on the combined weight of the formulation and filler and the filler comprises microspheres of aluminosilicate ceramic having an average particle size in a range of from 1 micrometer to 40 micrometers.

2. An abrasive article as claimed in claim 1 which comprises from 40 to 60% by weight of microspheres based on the combined weight of the formulation and filler.

3. An abrasive article as claimed in claim 1 in which the microspheres have an average particle size in a range from 1 micrometer to 20 micrometers.

4. An abrasive article as claimed in claim 3 in which the microspheres have an average particle size in a range from 1 micrometer to 10 micrometers.

5. An abrasive article as claimed in claim 1 in which the microspheres have an average particle size about 3 micrometers.

6. An abrasive article as claimed in claim 1 in which the microspheres are transparent to visible light.

7. An abrasive article as claimed in claim 1 in which the formulation further comprises mica and a visible light activated catalyst.

8. An abrasive article as claimed in claim 7 in which the mica is present in an amount up to about 22% by weight of the combined weight of the formulation, filler and mica.

9. An abrasive article as claimed in claim 7 in which, by weight, more of the microspheres are present than are the mica.

10. An abrasive article as claimed in claim 1 in which the formulation further comprises up to 2% by weight of an organo functional silane, based on the weight of filler.

11. An abrasive article as claimed in claim 10 in which the organo functional silane is a vinyl functional silane.

12. An abrasive article as claimed in claim 1 in which the formulation additionally comprises up to 2% by weight of a surfactant based on the total weight of the formulation and filler.

13. An abrasive article as claimed in claim 1 in which the the formulation further comprises an epoxy acrylate precursor and the formulation is obtained by curing a composition comprising epoxy acrylate.

14. An abrasive article as claimed in claim 1 comprising a layer of the cured formulation and filler.

15. An abrasive article as claimed in claim 1 in the form of a coated abrasive comprising abrasive particles which are supported on and adherently bonded to at least one major surface of a backing sheet by a make coating of a first binder material and a size coating of a second binder material, wherein at least one of the first or the second binder materials comprises the UV-cured formulation and filler.

16. An abrasive article as claimed in claim 15 in which the size coating comprises the UV-cured formulation and filler.

17. A method of making an abrasive article, the method comprising providing abrasive particles and a UV-curable formulation and a filler, wherein the filler is substantially transparent to UV-radiation and the filler is present in a range from 20 to 80 percent by weight based on the combined weight of the cured formulation and filler and the filler comprises microspheres of aluminosilicate ceramic having an average particle size in a range of from 1 micrometer to 40 micrometers; and curing the UV-curable formulation by exposing it to UV radiation for a time sufficient to effect cure of the UV-curable formulation.

18. The method as claimed in claim 17 wherein the filler comprises from 40 to 60% by weight of microspheres based on the combined weight of the formulation and filler.

19. The method as claimed in claim 17 in which the microspheres have an average particle size in a range from 1 micrometer to 20 micrometers.

20. The method as claimed in claim 17 in which the microspheres have an average particle size in a range from 1 micrometer to 10 micrometers.

21. The method as claimed in claim 17 in which the microspheres have an average particle size about 3 micrometers.

22. The method as claimed in claim 17 in which the microspheres are transparent to visible light.

23. The method as claimed in claim 17 in which the formulation further comprises mica and a visible light activated catalyst.

24. The method as claimed in claim 23 in which the mica is present in an amount up to about 22% by weight of the combined weight of the formulation, filler and mica.

25. The method as claimed in claim 23 in which, by weight, more of the microspheres are present than are the mica.

26. The method as claimed in claim 17 in which the formulation further comprises up to about 2% by weight of an organo functional silane, based on the weight of filler.

27. The method as claimed in claim 26 in which the organo functional silane is a vinyl functional silane.

28. The method as claimed in claim 17 in which the formulation additionally comprises up to about 2% by weight of a surfactant based on the weight of the formulation and filler.

29. The method as claimed in claim 17 in which the the formulation further comprises an epoxy acrylate precursor and the formulation is obtained by curing a composition comprising epoxy acrylate.

30. The method as claimed in claim 17 comprising a layer of the cured formulation and filler.

31. The method as claimed in claim 17 in the form of a coated abrasive further comprising coating the curable formulation on a backing sheet wherein abrasive particles are supported on and adherently bonded to at least one major surface of the backing sheet by a make coating of a first binder material and a size coating of a second binder material, wherein at least one of the first or the second binder materials comprises the UV-cured formulation and filler.

32. The method as claimed in claim 31 in which the size coating comprises the UV-cured formulation and filler.

33. A method of abrading the surface of a substrate comprising contacting an abrasive article comprising abrasive particles and a UV-cured formulation and a filler, wherein the filler is substantially transparent to UV-radiation and the filler is present in a range from 20 to 80 percent by weight based on the combined weight of the formulation and filler and the filler comprises microspheres of aluminosilicate ceramic having an average particle size in a range of from 1 micrometer to 40 micrometers with the substrate surface and moving at least one of the abrasive article or the substrate to abrade the surface.

* * * * *

UNITED STATES PATENT AND TRADEMARK OFFICE

CERTIFICATE OF CORRECTION

PATENT NO. : 6,951,577 B2
DATED : October 4, 2005
INVENTOR(S) : Carter, Christopher J.

It is certified that error appears in the above-identified patent and that said Letters Patent is hereby corrected as shown below:

Column 16,
Table 22, delete “C mp nent” and insert -- Component --.

Column 17,
Line 61, before “formulation”, delete “the”.

Column 18,
Line 60, after “which the”, delete “the”.

Signed and Sealed this

Twenty-fourth Day of January, 2006

JON W. DUDAS
*Director of the United States Patent and Trademark Office*